United States Patent [19]

Whitney

[11] 4,000,859

[45] Jan. 4, 1977

[54] TWO-PIECE HAMMER

[75] Inventor: Richard P. Whitney, East Moline, Ill.

[73] Assignee: Sivyer Steel Corporation, Milwaukee, Wis.

[22] Filed: Feb. 9, 1976

[21] Appl. No.: 656,414

[52] U.S. Cl. ..... 241/194; 241/197

[51] Int. Cl.[2] ..... B02C 13/28

[58] Field of Search ..... 241/189 R, 189 A, 191, 241/194, 195, 197

[56] References Cited

UNITED STATES PATENTS

| | | | |
|---|---|---|---|
| 2,183,880 | 12/1939 | Brooks | 241/197 |
| 2,531,597 | 11/1950 | Anderson | 241/197 |
| 2,566,798 | 9/1951 | Hiller | 241/194 |
| 2,605,972 | 8/1952 | LeBlanc | 241/197 |
| 2,982,486 | 5/1961 | Ehmann | 241/197 |
| 3,510,076 | 5/1970 | Perdue | 241/197 |
| 3,727,848 | 4/1973 | Francis | 241/194 |

*Primary Examiner*—Granville Y. Custer, Jr.
*Attorney, Agent, or Firm*—Quarles & Brady

[57] ABSTRACT

A two-piece hammer for a shredder has a separate hammer face and a separate hammer peen. The face and peen are complementary and have interlocking surfaces so that they may be mounted on a hammer disc or rotor by a single hammer pin to form a unitary hammer which allows the hammer face to be replaced when worn and the peen to be reused.

9 Claims, 6 Drawing Figures

*Fig. 1*
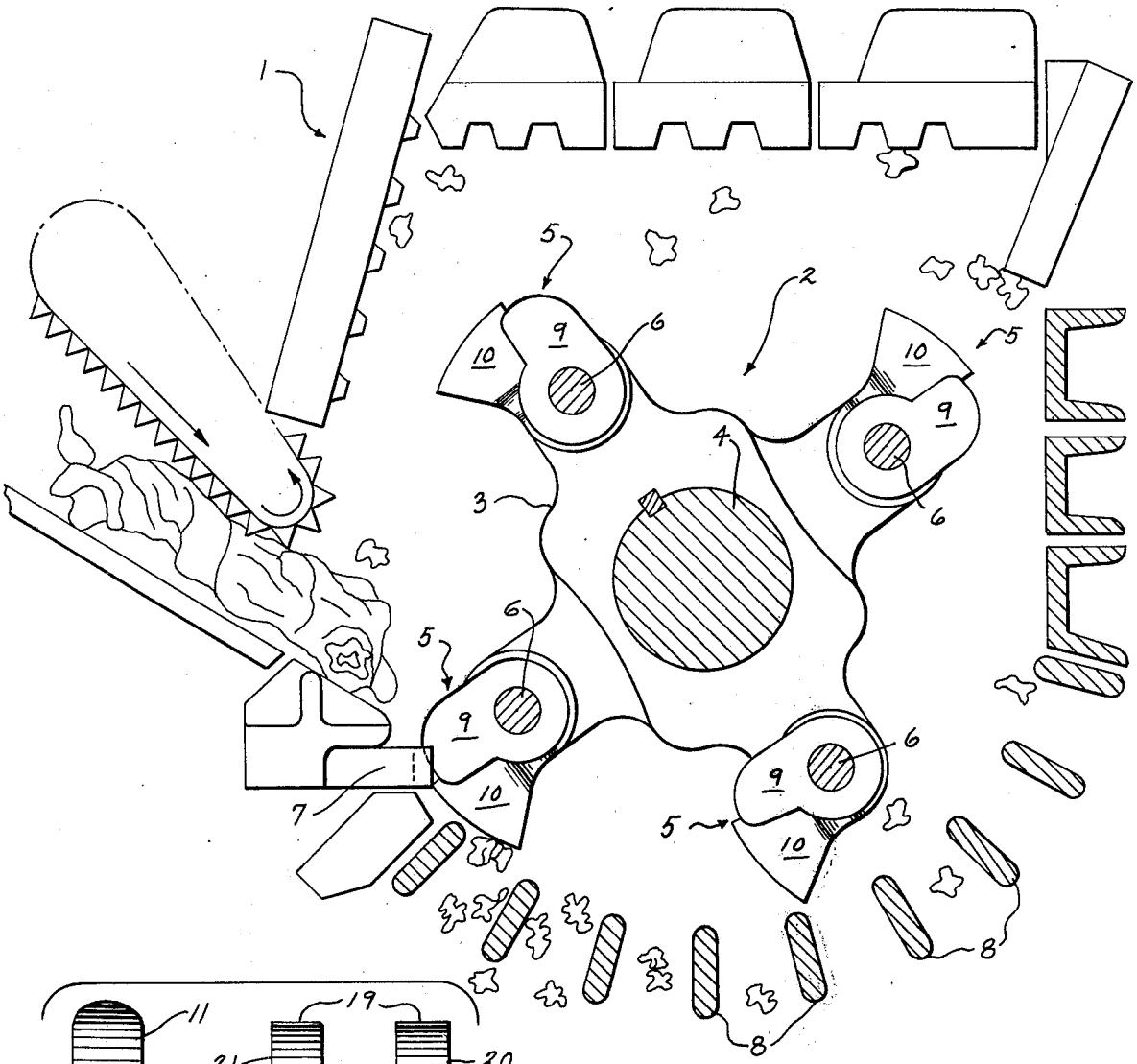
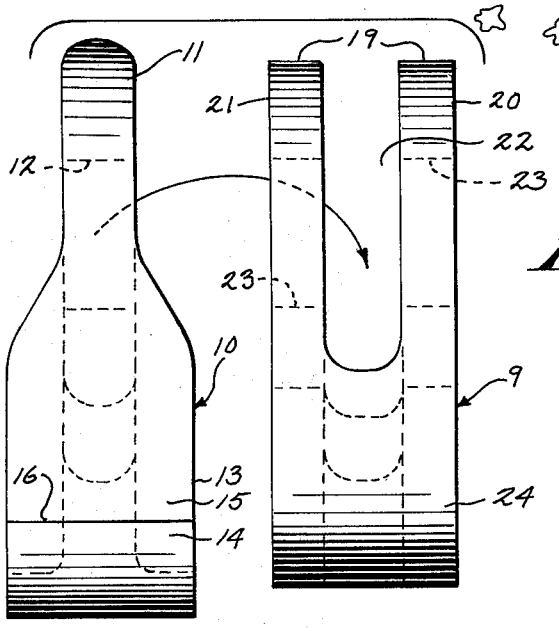
*Fig. 5*

TWO-PIECE HAMMER

BACKGROUND OF THE INVENTION

There is a continuing need for improvements in hammers for use with hammermills, shredders and rotary crushers. Such devices have been known for a long time, but a basic problem in this art has never been solved, that is, the problem of obtaining maximum shredding, crushing, or hammering action while minimizing the amount of metal hammer which is discarded after the hammer has worn to a point necessitating replacement or repair.

In the past, attempts have been made to solve this problem by providing hammers which have replaceable tips secured to the hammer shank by pins or other locking devices. However, such attempts have not been completely successful. The locking devices such as bolts, nuts, pins, wedges, and the like that have been used to fasten the tips to the shaft of the hammer, of necessity, have been made of less impact resistant materials than the hammer or tip and as a result have generally worn faster than the hammer tip or shaft. When a locking device fails, a tip can become unattached and because of its high impact resistant nature, become an instrument of destruction destroying additional tips and shredder components. In addition, both the points where the tips are connected to the shaft and the bolts, nuts, pins, wedges and the like tend to "lime" up or become impacted with finely ground material making it very difficult to remove the locking device and separate the tip from the shaft.

Representative of the types of two-piece hammers that have been employed in the past are those shown and illustrated in U.S. Pat. Nos. 2,531,597, 2,605,972 and 3,510,076. Although the improvements disclosed in the above patents do provide some advantages over singlepiece hammers they are not completely satisfactory.

SUMMARY OF THE INVENTION

A two-piece hammer is disclosed for use in a material shredder, hammermill or crusher. The hammer comprises a replaceable hammer face element which is provided at one end with a hammer pin engaging portion and at the other end with a material shredding face, and a separate reusable hammer peen element which has at one end a hammer pin engaging portion and at the other end a relatively heavy body section. The hammer peen and the hammer face are provided with interlocking means so that they can be united to form a unitary hammer in which the peen is positioned behind the hammer face and the hammer pin engaging portions of the two elements are aligned so that when the hammer is attached to a hammer bearing member by a single hammer pin the two elements cannot be separated and in operation the weight of the peen is effectively transferred to the hammer face to magnify the momentum and the centrifugal force behind said face and to thereby facilitate the shredding of material by said hammer face.

The separate hammer peen and the hammer face elements are each provided with their own hammer pin engaging portions thereby eliminating the need for threaded or machined fasteners and the risk of failure that accompanies the use of such fasteners. The elimination of fasteners provides an additional substantial advantage for the two elements may be inexpensively cast and need not be machined before they are assembled and used. In addition, the provision of individual pin engaging portions puts each of the elements in direct connection with the hammer rotor so that the momentum of the rotor is transferred directly to the shredding face and the peen.

The hammer pin engaging portions of each of the two elements serves still another function as they cooperate with the hammer pin and the interlocking surfaces of the two elements to form a unitary hammer. As a result of that cooperation the interlocking surfaces may have smooth angles and therefore also may be formed by casting thus avoiding the inherent structural weaknesses of sharp angled surfaces.

The use of the separate and unique hammer peen element makes it possible to concentrate as much of the weight of that hammer face element as possible in the actual shredding or working surface and as little as possible in the hammer pin engaging portion of the face element. This is achieved by providing a hammer peen in which the hammer pin engaging portion of the peen is adapted to receive the hammer pin engaging portion of the face and to strengthen it and protect it from impacts received in the shredding process.

It is also an object of this invention to provide a two-piece hammer in which the hammer face element is so constructed that it protects the reusable peen from damage. In that sense the two elements are complementary as the face protects the peen from damaging contact with materials to be shredded which might prevent it from being reused and the peen as previously described protects the face from damage from sidewise blows and excessive impacts. The provision of reusable peen also reduces dramatically the amount of "throw away" hammer material because the reusable peen weighs little more than the portion of a one-piece hammer that would have to be discarded as unusable. The result is a two-piece hammer which provides all the advantages of a one-piece hammer of the same general shape and size, but which has the important additional advantage of conserving hammer material.

A more limited object is to provide the particular structures herein disclosed.

The foregoing and other objects and advantages will appear from the following description. In that description, reference is made to the accompanying drawings which form a part thereof, and in which there is shown by way of illustration and not of limitation a preferred embodiment of the invention.

BRIEF DESCRIPTION OF THE DRAWINGS

In the drawings:

FIG. 1 is a vertical section through a shredder employing the hammers of the present invention;

FIG. 5 is a perspective view showing the back of the hammer peen element and the front of the hammer face element.

DESCRIPTION OF THE PREFERRED EMBODIMENT

Figure 2:
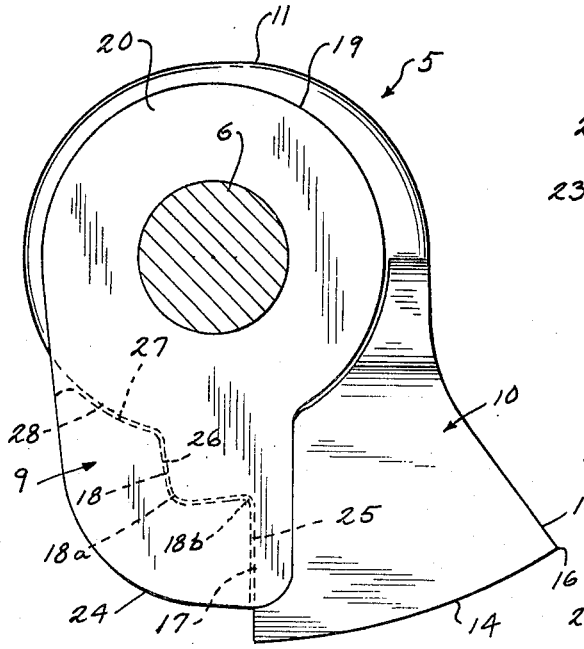
FIG. 2 is a perspective view of a single assembled hammer, with the interlocking and mating internal surfaces shown in broken lines.

In FIG. 1 is illustrated the cross-sectional elevation of the shredding chamber of a shredder 1 which has a rotary hammer assembly 2 mounted therein. The hammer assembly 2 comprises a series of four arm spiders 3 (only one is shown) which are mounted on a keyed to a shaft 4 which is journaled in bearings (not shown) that are structurally supported in the side walls of the shredder.

The hammer assembly includes the hammer 5 which are mounted in a pivotal position on the spider arms 3 by hammer pins 6. The hammers 5 coact with the teeth of mounted cutting comb 7 and with grate bars 8 that are circumferentially spaced around part of the orbit of the hammers to break up scrapped automobiles or any material in the shredder into sizes which will pass through the spaces between grate bars 8.

Referring now to FIG. 2 it can be seen that the hammer 5 is comprised of two elements, the reusable peen 9 and the replaceable hammer face 10 which are complementary in shape and interlock to form a unitary hammer body.

Figure 4:
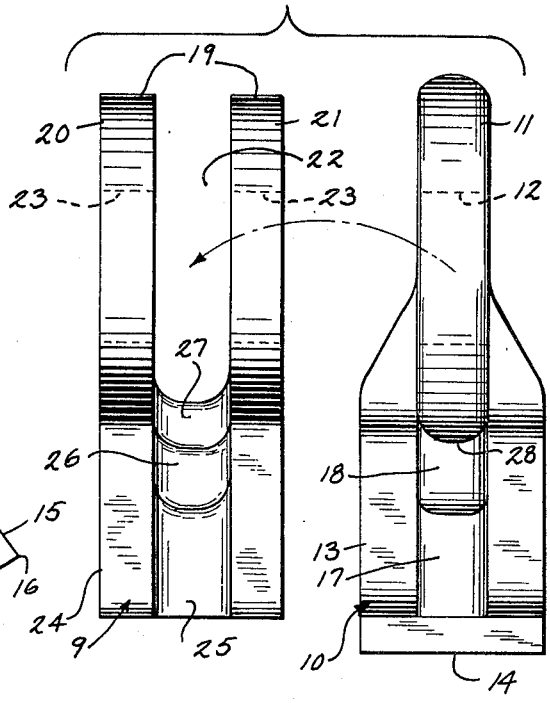
FIG. 4 is a perspective view showing the front of the hammer peen element and the back of the hammer face element.
Figure 3:
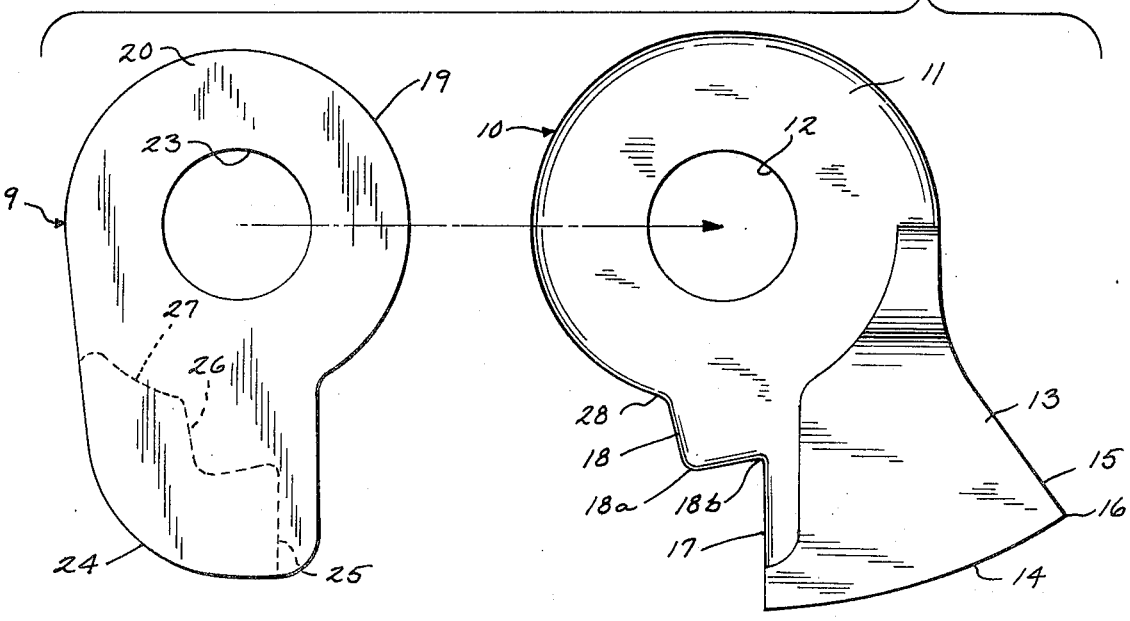
FIG. 3 is an exploded perspective side view showing the individual hammer elements.

As seen in FIGS. 3, 4 and 5 the face 10 has a relatively thin upper body portion 11 which is partly circular in shape and is provided with an eccentric hammer pin receiving aperture 12. The lower portion 13 of the face 10 is relatively thick and bell-shaped and is provided with a curved bottom 14, that joins a frontal shredding or cutting face 15 to form a relatively sharp cutting edge 16. As best seen in broken lines in FIG. 2 and solid lines in FIGS. 3 and 4, the back of the face 10 is partially cut away to form a tongue 17 and is provided with a radially protruding key 18. As seen in FIG. 2, point **18*b* where the key joins the main body of the face is closer to the axis of the hammer pin than the apex 18*a*** so that the key tapers radially outward.

In FIGS. 3, 4 and 5, it can also be seen that the peen 9 is provided with an upper body portion 19 which is partly circular in shape. As best seen in FIGS. 4 and 5 the upper body portion 19 is forked and the two branches 20 and 21 of the fork are spaced apart to form a groove 22. The groove 22 is shaped and sized to receive the upper body portion 11 of the hammer face 10 and each of the two branches 20 and 21 of the fork are provided with a hammer pin receiving aperture 23, 23 that is the same size as the aperture 12 of the face 10. As seen in FIG. 2 when the face 10 and peen 9 are united to form a unitary hammer 5, the apertures 12, 23, 23 are aligned and can be attached to the hammer assembly 2 by a hammer pin 6.

Figure 6:
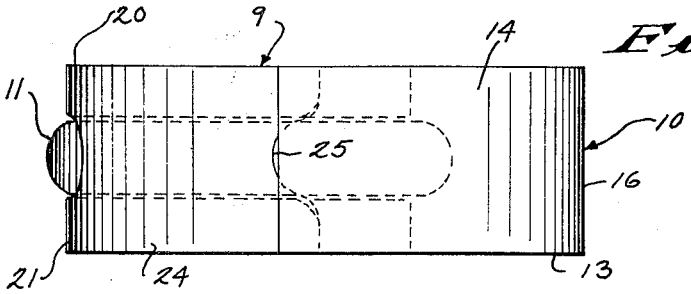
FIG. 6 is a bottom view of the assembled hammer of FIG. 2.

As seen in FIGS. 4, 5 and 6, the lower main body portion 24 of the peen 9 is the same thickness as the bell-shaped section 14 of the face element 10 and is provided with a tongue receiving groove 25 and a key-receiving recess 26 which are complementary to the tongue 17 and the key 18, respectively. The inner surface of the peen 9 is further recessed as at 27 to receive the curved portion 28 of the body portion 11 of the face 10. Thus, when the face element 10 and the peen element 9 are assembled to form a unitary hammer 5 as shown in FIG. 2, the hammer pin receiving apertures 12, 23 and 23 are aligned and the tongue 17 and groove 25 and the key 18 and recess 26 are in contact, respectively. As seen in the drawing the lower main body portion 24 of the peen 9 does not extend as far radially outwardly as does the bell-shaped section 13 of the face 10. Therefore the peen 9 and interlocking surfaces are protected from damage such as might occur if the peen encountered a force tending to separate the two hammer elements.

When the two elements are assembled in the manner indicated by broken lines in FIGS. 4 and 5 and as seen in FIG. 2, the confronting surfaces of the recess 26 of the peen 9 and the key 18 of the face 10 mate and interlock. This interlocking action is magnified by the fact that the apex **18*b* of the key is further from the axis of the hammer pin than the surface 18*a*. The interlocking action opposes the separation of the two elements by the impact force which is generated when the hammer 5 strikes material being fed into the shredder and it also effectively transfers the weight of the peen 9 to the face 10 to magnify the momentum and centrifugal force behind said face 9 and to thereby facilitate the shredding of material by cutting edge 16 of the face. In addition, the momentum created by the revolving hammer assembly 2** further assists in keeping the two hammer elements united at time of impact.

The two-piece hammer is protected from damage from sidewise blows by the interaction of the key 18 with the recess 26 and the tongue 17 with the groove 25. In addition, the hammer pin engaging portion 11 of the face 10 is strengthened and protected by the stirrup formed by branches 20 and 21 and groove 22 of the peen 9.

Although the peen 9 and the face 10 can be readily assembled without tools when they are not mounted, once they are assembled and a hammer pin 6 has been inserted through the apertures 12, 23 and 23, as shown in FIG. 2, the two elements cannot be separated because of the coaction of the key 18, the recess 26 and the pin 6.

It will be readily apparent that the potential for "liming up or otherwise locking the two items together is minimized because there are no locks or bolts required to secure the hammer face 10 to the hammer peen 9. Once the hammer pin 6 is removed, as might be desired when the face 10 is worn and is to be replaced, the two elements can be readily separated without tools.

It will be readily apparent to those skilled in the art that the hammer structure of the present invention provides for significant savings in the amount of "throwaway" metal. Normally a one-piece hammer would have to be discarded once the hammer had worn down to anything resembling the shape of the peen element. At that time the remaining portion of a one-piece hammer would then have to be scrapped or alternatively built up by the time consuming process of sputtering metal on the worn surfaces. The use of the two-piece hammer of the present invention results in savings in time and material.

While in the foregoing description the preferred embodiment of the invention has been set forth for purposes of explanation, it will be understood that many variations and changes may be made without departing from the spirit and scope of the invention. For example, while in the drawings the peen element has been shown as having female components and the replaceable hammer face element as having male components, the situation could in some instances be reversed. In addition, although the components appear to be relatively similar in size as shown in the drawings it is apparent that, if desired, a peen element which is much larger than the face element could be employed or vice versa.

I claim:

1. A two-piece hammer for use in a material shredder comprising: (a) a replaceable hammer face element having a hammer pin engaging portion and a material shredding face and (b) a separate reusable hammer peen portion having a hammer pin engaging portion and a relatively heavy body portion;

said hammer peen element and hammer face element being provided with interlocking means so that they can be united to form a unitary hammer in which the peen is positioned behind the hammer face and the hammer pin engaging portions of the two elements are aligned so that when the hammer is attached to a hammer bearing member by a single hammer pin the two elements cannot be separated and in operation the weight of the peen is effectively transferred to the hammer face to magnify the momentum and centrifugal force behind said face and to thereby facilitate the shredding of material by said hammer face.

2. The hammer of claim 1 in which the hammer pin engaging portion of the hammer face element is provided with a hammer pin receiving aperture and the hammer pin engaging portion of the hammer peen element is provided with a fork adapted to receive the hammer pin engaging portion of said hammer face, each branch of said fork having a hammer pin receiving aperture which aligns with the aperture of the hammer face when the face and the peen elements are positioned with the interlocking complementary surfaces in contact and the peen positioned behind the face.

3. The hammer of claim 1 in which the back portion of the hammer face element is further provided with an outwardly projecting tongue and the front portion of the hammer peen element is further provided with a complementary tongue receiving recess which mating surfaces cooperate when the hammer is attached by a pin to a hammer bearing member to help prevent the unitary hammer body from being separated by forces exerted on the sides of the hammer.

4. The hammer of claim 1 in which the hammer face element has a hammer pin engaging portion of reduced thickness and the hammer peen element has a slot in the hammer pin engaging portion thereof which is adapted to receive the hammer pin engaging portion of reduced thickness of the hammer face and the two hammer pin engaging portions have aligned apertures so that the two elements can be joined to a hammer bearing member by a single hammer pin.

5. The hammer of claim 4 in which the hammer pin engaging portion of the hammer face element has a hammer pin receiving aperture and the hammer peen element has a hammer pin engaging portion which has similar apertures so that when the hammer peen and hammer face are assembled, with complementary mating and interlocking surfaces in contact with each other, the apertures in the hammer peen and the hammer face are aligned and the unitary structure can be attached to a hammer bearing member by a single hammer pin.

6. In a hammermill or shredder for the shredding of materials the improved hammer which comprises: (a) a replaceable hammer face element having a hammer pin engaging portion and a material shredding face portion and (b) a separate reusable hammer peen portion having a hammer pin engaging portion and a relatively heavy body portion;

said hammer peen element and hammer face element being provided with interlocking means so that they can be united to form a unitary hammer in which the peen is positioned behind the hammer face and the hammer pin engaging portions of the two elements are aligned so that when the hammer is attached to a hammer bearing member by a single hammer pin the two elements cannot be separated and in operation the weight of the peen is effectively transferred to the hammer face to magnify the momentum and centrifugal force behind said face and to thereby facilitate the shredding of material by said hammer face.

7. A replaceable hammer face element for use with a reusable hammer peen having a hammer pin engaging portion, said face element comprising a body provided at one end with a hammer pin engaging portion and provided at the other end with a material shredding face, said hammer face element being provided with means for interlocking with the hammer peen so that they can be united to form a unitary hammer in which the peen is positioned behind the hammer face and the hammer pin engaging portions of the two elements are aligned so that when the hammer is attached to a hammer bearing member by a single hammer pin, the two elements cannot be separated and in operation the weight of the peen is effectively transferred to the hammer face to magnify the momentum and centrifugal force behind said face and to thereby facilitate the shredding of material by said hammer face 8. A reusable hammer peen element for use with a replaceable hammer face having a hammer pin engaging portion, said peen element comprising a body provided at one end with a hammer pin engaging portion and at the other end with a relatively heavy body portion; said hammer peen element being provided with means for interlocking with the hammer face so that they can be united to form a unitary hammer in which the peen is positioned behind the hammer face and the hammer pin engaging portion of the two elements are aligned so that when the hammer is attached to a hammer bearing member by a single hammer pin, the two elements cannot be separated and in operation the weight of the peen is effectively transferred to the hammer face to magnify the momentum and centrifugal force behind said face and to thereby facilitate the shredding of material by said hammer face.

9. A replaceable hammer face element for use with a reusable hammer peen to form a hammer for a shredder, said face element comprising a body provided at one end with a hammer pin engaging portion and provided at the other end with a relatively heavy shredding portion having a frontal shredding face and a back surface which is provided with means for interlocking with a reusable hammer peen having its own hammer pin engaging portion so that the two elements can be united to form a unitary hammer which when attached to a hammer bearing member by a single hammer pin cannot be separated into the two separate elements.

* * * * *